United States Patent [19]

Danne

[11] 4,315,571

[45] Feb. 16, 1982

[54] SLEEVE FOR GRAMOPHONE RECORDS

[75] Inventor: Friedrich A. Danne, Cologne, Fed. Rep. of Germany

[73] Assignee: "Octropa" B.V. Internationale Octrooi Maatschappij, Rotterdam, Netherlands

[21] Appl. No.: 914,170

[22] Filed: Jun. 9, 1978

[51] Int. Cl.[3] ..... B65D 85/30

[52] U.S. Cl. ..... 206/312; 229/48 SA

[58] Field of Search ..... 229/48 SA; 206/311, 206/312

[56] References Cited

U.S. PATENT DOCUMENTS

| | | | |
|---|---|---|---|
| 1,446,232 | 2/1923 | Wilburger | 206/311 |
| 3,456,863 | 7/1969 | Mollison et al. | 229/48 SA |
| 3,826,360 | 7/1974 | Shore | 206/312 |
| 3,951,332 | 4/1976 | Torbeck | 229/48 SA |

*Primary Examiner*—Joseph Man-Fu Moy

*Attorney, Agent, or Firm*—Barry Kramer

[57] ABSTRACT

The invention concerns an improvement of sleeves such as sleeves for gramophone records. The sleeves consist of a front and a back panel connected at one edge by a connecting strip, which is in the blank arranged between the two panels, and two other connecting strips extending from one panel and glued to edge zones of the other panel by means of gluing flaps. Gluing flaps and edge zones which are to be glued together in overlapping position are reduced in their thickness so that the seam is as thick as the material of the back panel. Reduction in thickness is achieved preferably by milling off a layer from the cardboard material of the gluing flaps from their outer surfaces as well as of the edge zones at their inner surfaces. The sleeves have panels of equal thickness so that the gramophone records are supported all around their edges and in their middle parts without causing bending when stacked.

4 Claims, 1 Drawing Figure

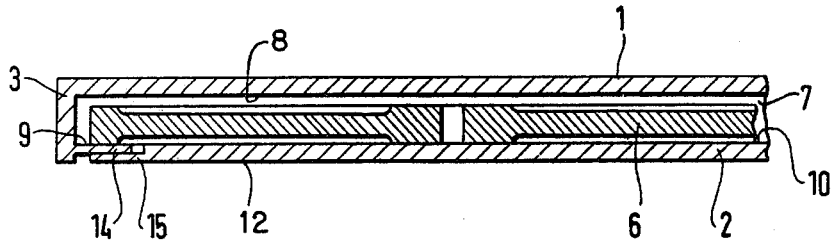
1
8
3
7
9
10
14
15
12
6
2

SLEEVE FOR GRAMOPHONE RECORDS

The invention relates to an improvement in the manufacture of sleeves for gramophone records and similar sleeves.

Conventional record sleeves consist of cardboard, of which the outer surfaces have been finished. On three sides narrow connecting strips are arranged, which hold the two panels together in such a way as to ensure a spacing of e.g. 2.0 mm between said panels. Whereas one of the connecting strips can be arranged between the two panels in the blank, the other two are provided with gluing flaps which are conventionally fixed on the inside of the back panel of the sleeve. The arrangement of the gluing flaps results in that in a horizontal position of the sleeve the record is supported on only two spots along its edges and thus gets bent during storage.

Instead of by connecting strips and gluing flaps the panels can also be connected via spacing ledges to be inserted between the panels. Spacing ledges and the application thereof on the panel surfaces are relatively expensive, so that for this reason their use seems to be limited.

The object of the invention is to improve sleeves such as record sleeves in such a way that without using spacing ledges the two inner surfaces are so shaped as to allow the entire edge as well as the centre of the record to be supported by said surfaces.

In the record sleeve according to the invention the front and back panels are immediately interconnected over a connecting strip at one edge of the sleeve, and at two other edges, on one panel, for example on the front panel, also connecting strips are arranged, which, as is known per se, are provided with gluing flaps that are glued to the inner surface of the other panel, which will be named the back panel whereby the thickness of the cardboard material of gluing flaps and edge zones is reduced, preferably by about half, thereby providing a seam as thick as the material of the back panel. This can be achieved by strong compression of the material. A preferred possibility of reducing the thickness of the material consists in that one layer of the material is milled off. By this milling operation the parts of the gluing flaps and the edge zones of the back panel that are to be glued together in overflapping position are each reduced to about half their thickness. Milling can be effected parallel to the material surface, or an approximately wedge-shaped layer is removed, the average thickness of which corresponds to about half the thickness of the material. It is also possible first to mill a thin layer and subsequently compress the remaining material of both parts to about the thickness of the remaining back panel. A preferred cardboard material from which a layer can be removed by milling is chromo triplex board of a quality such as is used for record sleeves. However, other cardboard may be used as well, and it can be provided with a lacquer or a thermoplastic coating.

The reduction in material thickness of the surfaces which are glued together in overlapping fashion not only results in a flat inner surface offering a good support for the record, but also in sleeves having the same total thickness over their entire surface, thus allowing a large number of filled sleeves to be stacked on top of each other. This makes it possible to package the records immediately after pressing, while still hot, into thin inner sleeves from paper and into the outer sleeves, and to store them in stacks even during cooling, without the records being deformed.

The accompanying drawings represents by way of example an embodiment, in which only part of a section of a sleeve containing a record is shown through an edge containing a gluing flap.

The record sleeve consists of a front panel 1, a back panel 2, and lateral connecting strips 3 extending e.g. from the front panel, on which gluing flaps 14 are provided, which have been glued to the edge zone 15 of the back panel 2. The sleeve contains a gramophone record 6, which may be enclosed in an inner sleeve from thin paper (not shown). In order to allow records of about 30 cm diameter in such an inner sleeve to be easily pushed into the outer sleeve shown, a spacing of 2.0 mm between the panels 1 and 2 is customary. This spacing is obtained at a corresponding width of the connecting strips 3 and the connecting strip 7 which immediately connects the panels 1 and 2. The parts 1, 2, 3, 14, 15 and 7 are connected to each other in the cardboard blank, and on both sides of the connecting strips 7 and 14 fold lines are provided. The cardboard material is relatively stiff and the outer sides may be printed, lacquered and/or coated. For technical reasons related to manufacture as well as with a view to a better appearance the gluing flap 14 is connected with the inner surface 10 of the back panel 2 and to the inner surface of its edge zone, respectively. Whereas the inner side 8 of the front panel 1 forms a continuous supporting surface for the record 6, in conventional record sleeves the records are, on the back panel, only supported at two spots of their edges on the inner sides of the two gluing flaps.

As shown, according to the invention the inner sides 9 of the gluing flaps 14 are arranged in the same plane as the inner sides 10 of the back panels 2, so that the records 6 can rest with both their entire edge and with their central part on a back panel plane formed by the inner surfaces 10 of the back panel and 9 of the gluing flaps and are thus protected against bending on storage. The surfaces to be glued together of the gluing flap 14 and of the edge zone 15 are reduced in thickness, preferably to such an extent that the thickness of both parts after the gluing operation is equal to the thickness of the back panel 2. Dependent on the material used, the reduction in thickness of the parts will be effected before or during the formation of the seam. In the case of cardboard material that can be compressed to a sufficient degree, the reduction in thickness can be effected by strong compression. For other cardboard material it may be advantageous to previously mill off a layer from both parts, this operation being effected on the outside of the gluing flap 14 and on the inside of the edge zone 15. In this arrangement, which is considered advantageous, the printed and possibly coated outer surface 12 of the back panel 2 extends up to the connecting strip 3 or even covers its edge too, so that the split is substantially invisible and does not disturb the printed image. In the case of material containing thick thermoplastic layers, the plastic material can be melted and compressed in such a way that the split present is filled up and a seam is formed without any annoying material thickening and in particular a flat surface is obtained on the inside of the back panel 2.

What is claimed is:

1. A sleeve for a phonograph record or the like, including:

front and back spaced apart, generally parallel panels forming a receptacle area therebetween for receiving said record therein, said panels including first and second spaced pairs of laterally extending opposed edge zones, each of said edge zones of said back panel including portions adjacent said receptacle area having a thickness less than the thickness of central areas of said back panel; and a pair of connecting strips respectively extending between said first and second pairs of said edge zones for inter-connecting said panels, each of said strips including a flap extending generally parallel to said panels and disposed within said portion of the corresponding edge zone in overlapping relationship to the latter, the surface of each of said flaps adjacent said receptacle area lying in the same plane as the inner surface of said back panel whereby to form a continuous surface for supporting both the center as well as the periphery of said record.

2. The invention of claim 1, wherein the thickness of both said flaps and said corresponding edge zone portions is approximately one-half of the thickness of said central areas of said back panel.

3. The invention of claim 2, wherein the material comprising said back panel is compressed to a greater density in said edge zone portions thereof than in said central areas thereof.

4. The invention of claim 2, wherein each of said flaps and the corresponding strip form a notched area adjacent the outer surface of said back panel for receiving said edge zone portion therein.

* * * * *